US011738962B2

(12) United States Patent
Nelson et al.

(10) Patent No.: US 11,738,962 B2
(45) Date of Patent: Aug. 29, 2023

(54) APPARATUS AND METHOD FOR SPLICING A WEB OF MATERIAL

(71) Applicant: Curt G. Joa, Inc., Sheboygan Falls, WI (US)

(72) Inventors: Christopher J. Nelson, Plymouth, WI (US); Jeffrey W. Fritz, Plymouth, WI (US); Lloyd F. Kreif, Sheboygan Falls, WI (US); Phillip J. Kocken, Sheboygan Falls, WI (US)

(73) Assignee: CURT G. JOA, INC., Sheboygan Falls, WI (US)

( * ) Notice: Subject to any disclaimer, the term of this patent is extended or adjusted under 35 U.S.C. 154(b) by 382 days.

(21) Appl. No.: 16/948,377

(22) Filed: Sep. 16, 2020

(65) Prior Publication Data

US 2021/0087009 A1 Mar. 25, 2021

Related U.S. Application Data

(60) Provisional application No. 62/902,450, filed on Sep. 19, 2019.

(51) Int. Cl.
*B65H 19/18* (2006.01)

(52) U.S. Cl.
CPC ..... *B65H 19/1889* (2013.01); *B65H 19/1836* (2013.01)

(58) Field of Classification Search
None
See application file for complete search history.

(56) References Cited

U.S. PATENT DOCUMENTS

| | | | | |
|---|---|---|---|---|
| 3,306,546 A | | 2/1967 | Ryan | |
| 3,460,775 A | | 8/1969 | Ford et al. | |
| 3,589,100 A | | 6/1971 | Konars et al. | |
| 3,655,143 A | | 4/1972 | Wallis | |
| 4,234,365 A | * | 11/1980 | Shimizu | B65H 19/1868 156/64 |
| 4,443,291 A | | 4/1984 | Reed | |
| 5,190,234 A | * | 3/1993 | Ezekiel | B65H 19/1852 242/552 |
| 5,253,819 A | | 10/1993 | Butler, Jr. | |
| 5,698,060 A | | 12/1997 | Long | |

(Continued)

FOREIGN PATENT DOCUMENTS

| | | |
|---|---|---|
| EP | 0600514 A2 | 6/1994 |
| GB | 1580727 A | 12/1980 |

(Continued)

*Primary Examiner* — William A. Rivera
(74) *Attorney, Agent, or Firm* — KLINTWORTH & ROZENBLAT IP LLP

(57) ABSTRACT

An apparatus for splicing comprises a first web support surface configured to support a traveling web thereon and a second web support surface configured to support a replacement web thereon. The first traveling web travels in a machine direction. The splicing assembly also comprises a first web sensor and a web joiner. A controller is configured to determine, via the first web sensor, a position of a trailing end of the traveling web and to, in response to determining the position of the trailing end, cause a leading end of the replacement web to be positioned adjacently to the trailing end. The computer is also configured to control the web joiner to create a joint coupling the trailing end to the leading end.

20 Claims, 12 Drawing Sheets

(56) References Cited

U.S. PATENT DOCUMENTS

| | | | | |
|---|---|---|---|---|
| 6,364,244 | B1 * | 4/2002 | Pasquale | B65H 19/181 242/554.6 |
| 6,701,992 | B1 | 3/2004 | Pasquale et al. | |
| 6,860,309 | B2 * | 3/2005 | Hartman | B26D 5/20 156/507 |
| 7,128,795 | B2 * | 10/2006 | Byrne | B65H 19/286 156/159 |
| 8,839,835 | B2 | 9/2014 | Benner et al. | |
| 10,420,268 | B2 * | 9/2019 | Eguchi | H05K 13/0215 |
| 10,457,512 | B2 | 10/2019 | Pasquale | |
| 10,640,928 | B2 * | 5/2020 | Ziegenbein | D21H 17/44 |
| 11,208,222 | B2 * | 12/2021 | Shimoda | B65B 9/20 |
| 2003/0209629 | A1 * | 11/2003 | Hirata | B65H 19/1852 242/554.2 |
| 2004/0084561 | A1 * | 5/2004 | Clifford | B65H 23/032 242/598.2 |
| 2005/0077418 | A1 * | 4/2005 | Werner | B65H 19/1868 242/554.5 |
| 2008/0169373 | A1 | 7/2008 | Andrews et al. | |
| 2018/0079614 | A1 * | 3/2018 | Pasquale | B65H 19/1826 |

FOREIGN PATENT DOCUMENTS

| | | | |
|---|---|---|---|
| GB | 2135283 | A | 8/1984 |
| JP | H0361247 | A | 3/1991 |
| WO | 9116255 | A1 | 10/1991 |

* cited by examiner

APPARATUS AND METHOD FOR SPLICING A WEB OF MATERIAL

CROSS-REFERENCE TO RELATED APPLICATIONS

This application is a nonprovisional of and claims the benefit of U.S. Patent Application Ser. No. 62/902,450, filed Sep. 19, 2019, the disclosure of which is incorporated herein by reference in its entirety.

BACKGROUND OF THE INVENTION

This invention generally relates to manufacturing processes, and in particular to splicing two portions of supply material for downstream use.

Personal care absorbent articles such as disposable diapers, training pants, other infant care products, feminine care products, incontinence articles, and other adult care products are typically manufactured using high-speed processing machines that convert one or more stabilized webs or ribbons of one or more fibrous absorbent materials into an article. Each web is pre-formed and provided to the machine as a wound roll or coil. As the web is unwound from the coil, it is processed in a fiberizer or fluff generator, which breaks the web up into small fibers that accumulate to form an absorbent core for the article.

To provide a continuous web to the processing machine, a trailing end of each coil is spliced to a leading end of the next coil. Splicing techniques include overlapping lap splices and butt splices. In one conventional splicing technique, advancement of the trailing end of the expiring coil is temporarily halted so that the leading edge of the replacement coil can be manually joined thereto by an operator. However, one drawback of halting of the web is at least the temporary interruption of the processing machine. In a high-speed environment, even the temporary halting of the fibrous absorbent web can be undesirous.

Accordingly, there is a need for an improved apparatus that allows for splicing a new coil to the end of an expiring coil without halting or stopping the advancement of the traveling web.

BRIEF STATEMENT OF THE INVENTION

Embodiments of the present invention are directed to the splicing of a traveling web. More specifically, embodiments of the present invention are directed to creating a butt splice between the end of an expiring web and the end of a subsequent web.

In accordance with one aspect of the invention, an apparatus for splicing comprises a first web support surface configured to support a traveling web thereon and a second web support surface configured to support a replacement web thereon. The first traveling web travels in a machine direction. The splicing assembly also comprises a first web sensor and a web joiner. A controller is configured to determine, via the first web sensor, a position of a trailing end of the traveling web and to, in response to determining the position of the trailing end, cause a leading end of the replacement web to be positioned adjacently to the trailing end. The computer is also configured to control the web joiner to create a joint coupling the trailing end to the leading end.

In accordance with another aspect of the invention, a method for splicing a first web to a second web comprises detecting a position of a trailing edge of a traveling web traveling in a machine direction and positioning a leading edge of a supply web adjacently to the trailing edge. The method also comprises actuating a web joiner and creating a joint between the trailing edge and the leading edge via the web joiner to couple the trailing edge of the traveling web to the leading edge of the supply web.

In accordance with yet another aspect of the invention, a splicing system comprises first and second splicing assemblies. The first splicing assembly comprises first and second support surfaces configured to support respective first and second material webs thereon and a fastener applicator configured to apply a first fastener to the first and second material webs. The second splicing assembly comprises third and fourth support surfaces configured to support respective third and fourth material webs thereon and a fastener applicator configured to apply a second fastener to the third and fourth material webs. The splicing system also comprises a web edge detection system, a receiving system configured to receive the first, second, third, and fourth material webs, and a controller. The controller is configured to determine, via the web edge detection system, a position of a trailing end of the first material web, to cause a leading end of the second material web to be positioned adjacently to the determined trailing end position of the first material web, and to control the fastener applicator of the first splicing assembly to couple the trailing end of the first material web to the leading end of the second material web via the first fastener. The controller is also configured to determine, via the web edge detection system, a position of a trailing end of the third material web, to cause a leading end of the fourth material web to be positioned adjacently to the determined trailing end position of the third material web, to control the fastener applicator of the first splicing assembly to couple the trailing end of the third material web to the leading end of the fourth material web via the second fastener, and to supply the joined first and second material webs and the joined third and fourth material webs to the receiving system.

These and other advantages and features will be more readily understood from the following detailed description of preferred embodiments of the invention that is provided in connection with the accompanying drawings.

BRIEF DESCRIPTION OF THE DRAWINGS

The drawings illustrate embodiments presently contemplated for carrying out the invention.

In the drawings:

FIGS. 1-6 illustrate a method of performing a butt splice using the splicing assembly of FIG. 1 according to an embodiment of the invention.

DETAILED DESCRIPTION

Embodiments of the present invention provide for an apparatus and method for splicing the end of a traveling web from a depleting roll with the end of a replacement roll. A flying roll change is performed without a significant break or change in the speed of the traveling web. Prior to the depletion of the traveling web from a first roll, the leading edge of a replacement roll is queued up and placed in a standby position awaiting detection of the end of the depleting roll. After the end of the depleting roll has been detected, the leading edge of the replacement roll is accelerated into a position adjacent to the end of the depleting roll so that a splice may be formed to join the adjacent ends to create a continuous web with the replacement roll. The spliced web material may then be delivered to various downstream manufacturing processes. In one embodiment, the web material is delivered to a fiberizer. In another embodiment, the spliced material may undergo one or more processing steps before being subsequently separated into discrete pieces that form part of a manufactured article. The web material may be a pulp material, a nonwoven material, a woven material, a film, a foam, and/or composites or laminates of any of these material types, as non-limiting examples.

Figure 1:
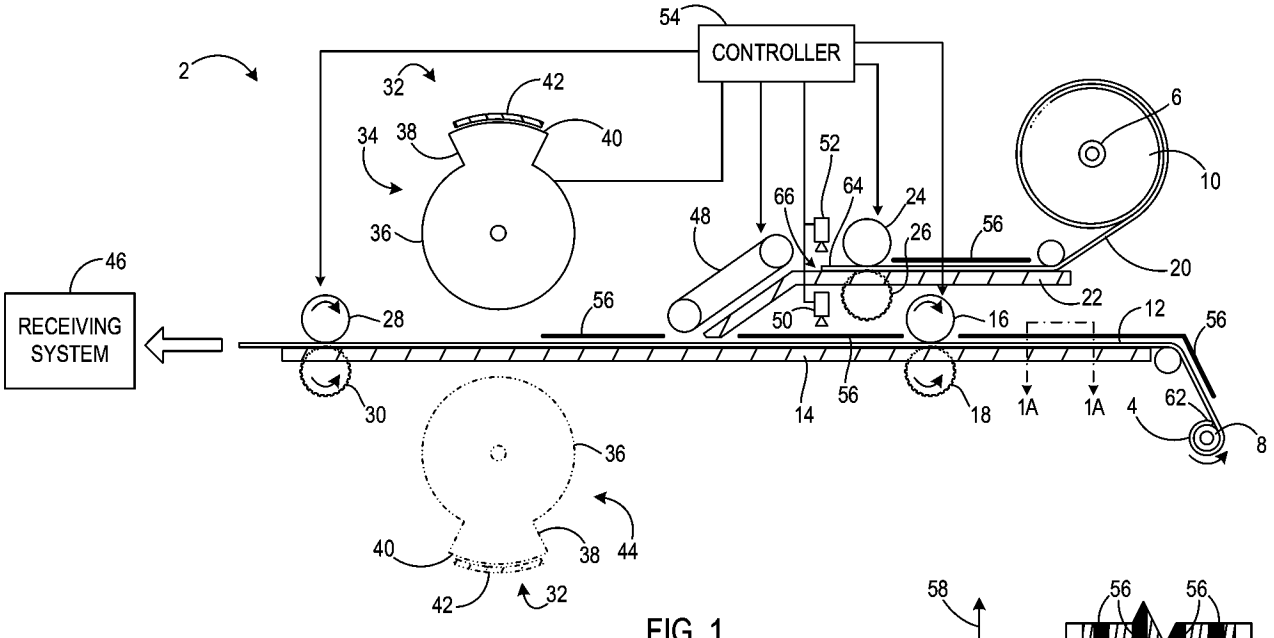
FIG. 1 illustrates a splicing assembly according to an embodiment of the invention.

FIG. 1 illustrates a splice assembly 2 according to an embodiment of the invention. A first material roll 4 and a second material roll 6 are shown mounted on respective first and second unwinding mandrels 8, 10. First material roll 4 includes a first web 12 capable of being drawn along a first web support surface 14 by a first pair of input rollers 16, 18 turning in counterrotation to each other. Second material roll 6 includes a second web 20 capable of being drawn along a second web support surface 22 by a second pair of input rollers 24, 26 turning in counterrotation to each other. First and second web support surfaces 14, 22 may be conveyors, guide rolls, rigid surfaces, and the like capable of supporting the first and second webs 12, 20 as the webs 12, 20 travel downstream along their intended paths through the splice assembly 2.

A pair of output rollers 28, 30 positioned near an opposite end of the first web support surface 14 draws the first and second webs 12, 20 through the splice assembly 2 and past a web joiner 32 such as a splice fastener applicator 34, which includes a wheel 36 having a protuberance or protrusion 38 extending therefrom. A fastener application surface 40 of the protrusion 38 is designed to receive and temporarily secure a splice fastener 42 thereto in preparation for application of the splice fastener 42 to the first and second webs 12, 20 to create a butt splice. The splice fastener 42 may be tape or other adhesive-based coupler configured to join the ends or edges of the first and second webs 12, 20 together. In one embodiment, a second web joiner 32 (i.e., splice fastener applicator 44) may be positioned below the first web support surface 14 as illustrated in phantom in FIG. 1. In this manner, a pair of splice fasteners 42 may be positioned on both sides of the butt splice to strengthen the joint. Alternatively, the splice fastener applicator 44 positioned below the first web support surface 14 may be the only applicator in the splice assembly 2 if having a splice fastener 42 on the bottom of the joined webs 12, 20 is preferred.

The running or traveling web drawn through the pair of output rollers 28, 30 is directed toward and fed into a receiving system 46 for further processing of the running web downstream. In one embodiment, the receiving system 46 is a fiberizer that converts the web into small particle absorbent fibers, creating a fluff gatherable into an adhesive core configured to absorb and retain liquid. In other embodiments, the receiving system 46 may be configured to receive material webs suitable for gowns, absorbent sanitary products, or other articles made from supply webs.

Second web support surface 22 is positioned offset from first web support surface 14. As illustrated, second web support surface 22 is positioned vertically above the first web support surface 14. However, the second web support surface 22 may be positioned in any offset position sufficient to allow the second web 20 to be directed toward the first web support surface 14. A web diversion assembly 48, such as a conveyor belt, is positioned adjacently to the second web support surface 22 to assist in diverting the second web 20 toward the first web support surface 14.

Detection of the placements and positions of the first and second webs 12, 20 is accomplished via a web edge detection system having, for example, respective first and second web sensors 50, 52 in the embodiments illustrated in FIGS. 1-6 configured to detect the leading and trailing edges of the first and second webs 12, 20. However, as illustrated and described hereinbelow in FIG. 8, a single web sensor 84 may be configured to detect the placements and positions of the first and second webs 12, 20. In all of the embodiments of the splice assemblies 2, 82, 88, 90 herein, use of any of the web sensors 50, 52, 84 singly or in combination to detect the leading and trailing edges of the first and second webs 12, 20 is contemplated. First and second web sensors 50, 52 may be any type of sensor capable of sensing the end of the running web (e.g., first web 12). For example, the sensors 50, 52 may be vision/optical sensors such as cameras configured to capture images of the running web within its field-of-view to determine the position of the end of the running web. In addition, optical sensors can include one or more IR emitter/detector pairs configured to detect the passing of the end of the running web through a detection zone. Embodiments of the invention, however, contemplate other types of optical sensors as well as non-optical detectors/sensors configured to detect the end of the running web.

First and second web sensors 50, 52 are coupled to a controller 54 configured to electronically control the splice assembly 2. In one embodiment, controller 54 may be a single controller or program; however, in other embodiments, multiple controllers and/or programs may work together for a single purpose of controlling the splice assembly 2. Controller 54 is coupled to the actuators (not shown) connected to the pair of output rollers 28, 30, the splice fastener applicator 34, the web diversion assembly 48, the first pair of input rollers 16, 18, and the second pair of input rollers 24, 26.

Figure 1A:
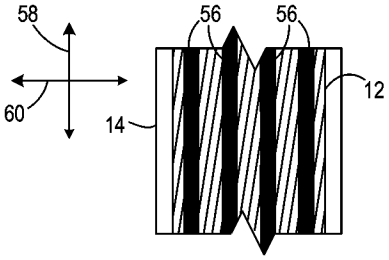
FIG. 1A illustrates a top plan view of a portion of the splicing assembly along lines 1A-1A of FIG. 1.

FIG. 1 additionally shows optional guides 56 positioned adjacently to the web support surfaces 14, 22 and other areas along which the first and second webs 12, 20 pass. The guides 56 facilitate guidance of the first and second webs 12, 20 along their intended routes and can help to flatten the trailing ends 62 of the first and second webs 12, 20 if they tend to curl away from their running paths. The guides 56 may be flat cover plates, conveyors with or without vacuum, flat bars or alternative known guiding means as non-limiting examples. FIG. 1A is a top plan view along lines 1A-1A of FIG. 1 that illustrates a plurality of bar guides 56 extending along the machine direction 58 and spaced apart in the cross-machine direction 60. Embodiments of the invention can include one guide 56 or multiple side-by-side guides 56 as illustrated in FIG. 1A to assist with the guidance of the running webs 12, 20 along their paths. Furthermore, the guides 56 may be positioned below the webs in alternative embodiments.

Referring now to FIGS. 1-6, a method of creating a butt splice is now described. FIG. 1 illustrates the first web 12 of supply roll 4 being drawn into and through splice assembly 2 via the first pair of input rollers 16, 18 and the pair of output rollers 28, 30 as it is fed toward receiving system 46. Controller 54 controls the first pair of input rollers 16, 18 and the pair of output rollers 28, 30 to draw the web 12 through the splice assembly 2. Though supply roll 4 is illustrated with sufficient web 12 throughout the splice assembly 2, it is shown in FIG. 1 as nearing its end 62.

A replacement roll 6 is shown mounted on the second unwind mandrel 10 with its web 20 partially extending into the splice assembly 2. While the first web 12 is being drawn through the splice assembly 2, an operator or automated system may install the replacement roll 10 and feed its web 20 into the splice assembly 2 to await its use at the expiration of the first web 12 of the first material roll 4. In one example, the operator or automated system may feed the leading end 64 of the replacement supply web 20 to the second pair of input rollers 24, 26 controlled by controller 54 while the controller 54 activates the second web sensor 52 to determine when the end 64 of the replacement supply web 20 has reached a starting point 66. The controller 54 may then deactivate the second pair of input rollers 24, 26, leaving the replacement supply web 20 primed and ready to be spliced into the running web 12 when it expires.

Figure 2:
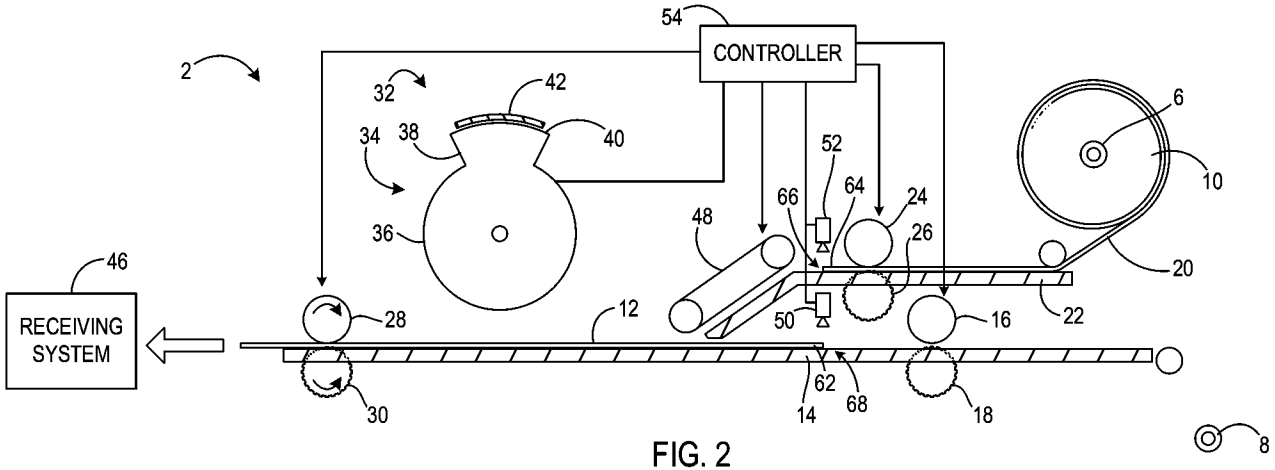

While the first running web 12 is being drawn through the splice assembly 2, controller 54 operates and/or receives a signal from the first web sensor 50 regarding the status of the first web 12. While the first web 12 is drawn along the first web support surface 14 under the first web sensor 50, the first web sensor 50 senses that supply from the first material roll 4 has not yet been exhausted, and the controller 54 continues to draw the first web 12 through the splice assembly 2. However, when the terminating or expiring end 62 of the first web 12 passes a detection point 68 in the sensing area of the first web sensor 50 as illustrated in FIG. 2, the first web sensor 50 communicates to the controller 54 that the expiring end 62 has been detected.

Figure 3:
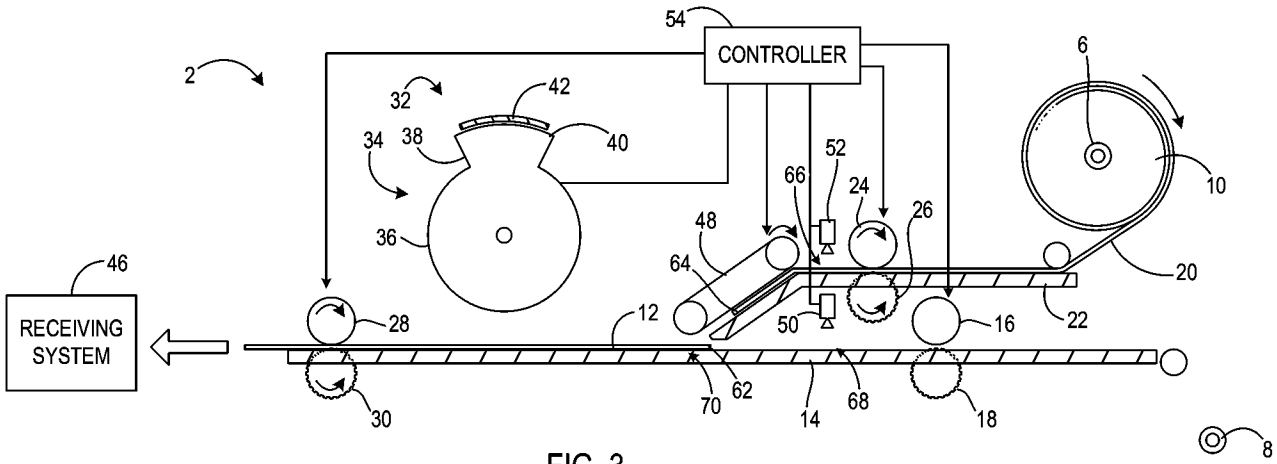

In response to the detection of the expiring end 62, the controller 54 activates the second pair of input rollers 24, 26 as shown in FIG. 3 to position the leading end 64 of the replacement supply web 20 next to the trailing end 62 of the expiring web 12 in preparation for creating a butt splice. Without halting the pair of output rollers 28, 30 so that supply of the first web 12 to the receiving system 46 is not stopped, the controller 54 uses the second pair of input rollers 24, 26 to accelerate the leading end 64 of the second web 20 from its initial starting speed to a speed sufficient to position the leading end 64 of the second web 20 adjacent to the trailing end 62 of the first web 12. To assist in deviation of the leading end 64 of the second web 20 along the slanted surface of the second web support surface 22, the web diversion assembly 48 may be activated by the controller 54 to urge or force the leading end 64 of the second web 20 to follow the slanted surface.

In one embodiment, the location of the starting point 66 allows for the second web 20 to be accelerated from an initial speed of zero to the running speed of the first web 12 so that as the second web 20 reaches the running speed of the first web 12, the ends 62, 64 of the respective webs 12, 20 are properly aligned. In another embodiment, the location of the starting point 66 places the leading end 64 of the second web 20 at a greater travel distance from a merge point 70 of the first web support surface 14 than the detection point 68. In this case, the controller 54 uses the second pair of input rollers 24, 26 to accelerate the leading end 64 of the second web 20 from its initial starting speed of zero to a speed greater than the running speed of the first web 12 until the leading end 64 of the second web 20 has caught up to or has become sufficiently close to the trailing end 62 of the first web 12 so that its speed may be decelerated to match or substantially match the running speed of the first web 12. To prepare the placement of the ends 62, 64 of the first web 12 and the second web 20 for the butt splice, the respective speeds of the first and second webs 12, 20 are substantially matched prior to applying a splice fastener. The speed of the webs 12, 20 and the positions of the starting point 66, detection point 68, and merge point 70 may be known in advance so that the program controlling the controller 54 is capable of actuating the splice assembly 2 to correctly position the ends 62, 64 of the first and second webs 12, 20 in response to end detection. For example, a delay in the acceleration of the replacement web may occur after detection of a respective web end based on the travel times and positions of the detected expiring end and the primed and ready leading end.

Figure 4:
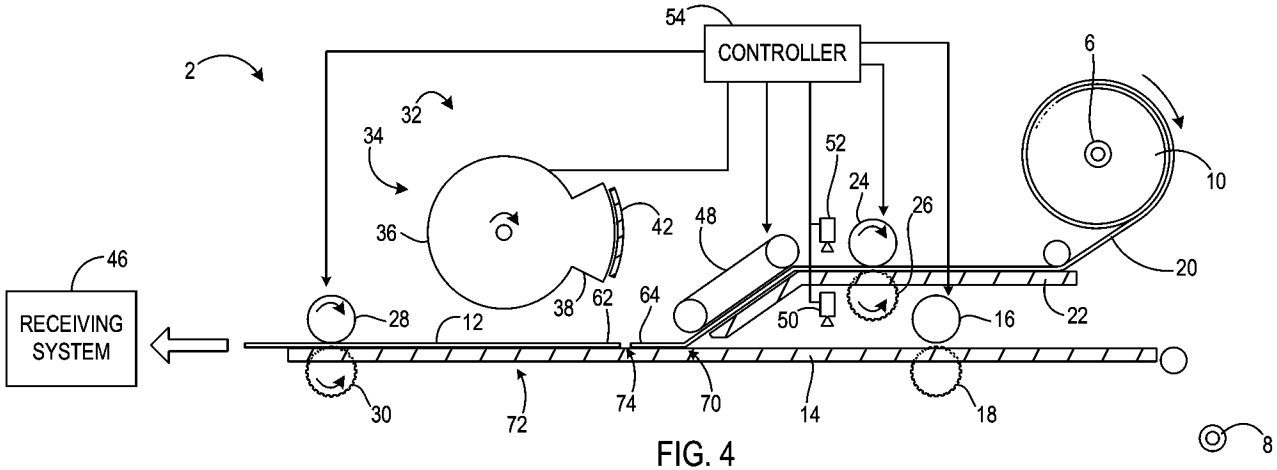

Referring to FIG. 4, the ends 62, 64 of the first and second webs 12, 20 travel along the first web support surface 14 toward the splice fastener applicator 34. In preparation for arrival of the ends 62, 64 within an application zone 72, the controller 54 controls rotation of the splice fastener applicator 34 so that the splice fastener 42 will be in position when the ends 62, 64 arrive. In one embodiment, the ends 62, 64 of the first and second webs 12, 20 are spaced apart by a gap 74 with a sufficient tolerance to allow for small variations in the positions of the ends 62, 64 to be successfully spliced via the splice fastener 42.

Figure 5:
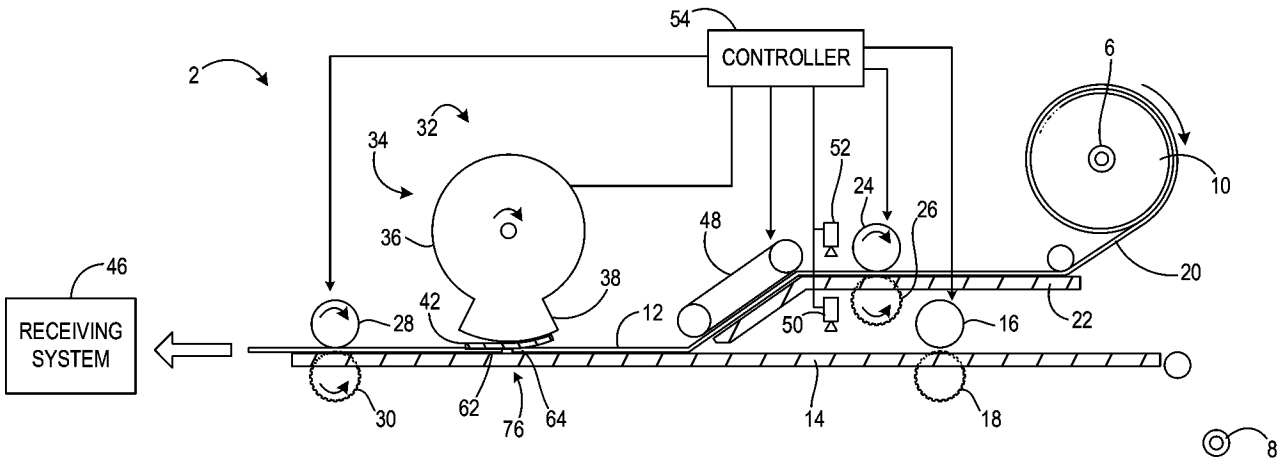

As illustrated in FIG. 5, the travel of the ends 62, 64 of the first and second webs 12, 20 through the application zone 72 is timed with the rotation of the splice fastener applicator 34 so that the splice fastener 42 is attached to the ends 62, 64 to create a butt joint 76 where the first web 12 and the second web 20 are spliced or joined together in a non-overlapping arrangement. In this manner, a continuous supply of absorbent web is provided to the receiving system 46 without a break in the operation of the system so that even a temporary stopping of the web supply is avoided.

Figure 6:
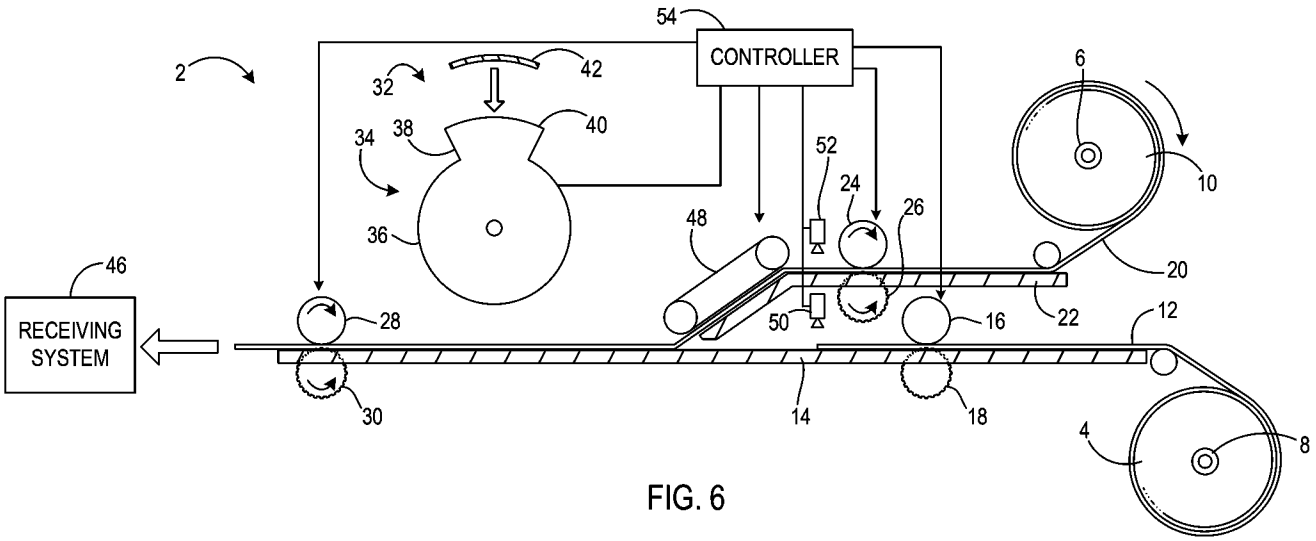

Referring to FIG. 6, the second web 20 has become the web supplied to the receiving system 46 due to being spliced to the previous running web. Accordingly, the operator or automated system may install the replacement roll 4 and feed it into the splice assembly 2 in a similar manner as described herein to prime the reserve web 12 for its use in being spliced to a trailing end of the second web 20.

Figure 7:
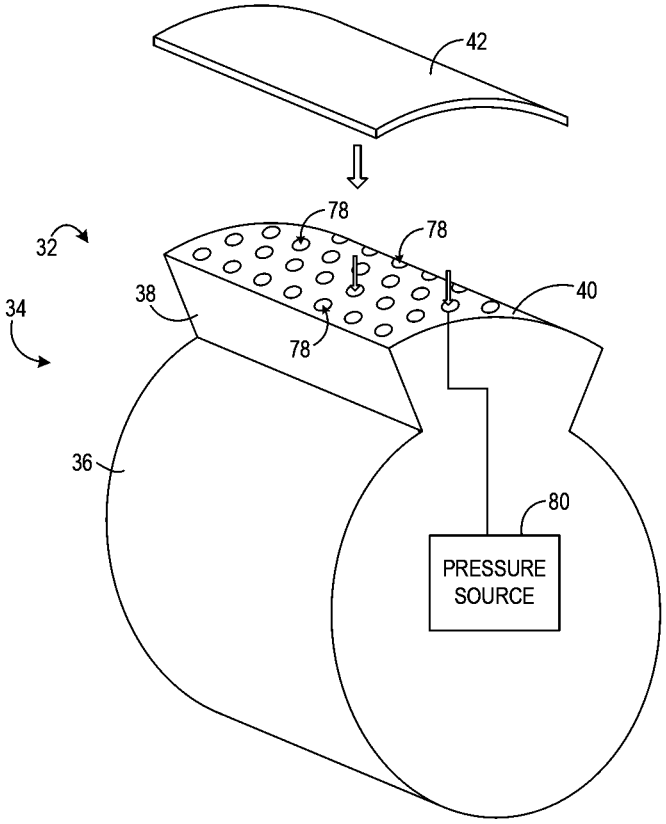
FIG. 7 illustrates an isometric view of a splice fastener applicator according to an embodiment of the invention.

FIG. 7 illustrates an isometric view of the splice fastener applicator 34 according to an embodiment of the invention. A plurality of apertures 78 are formed in the fastener application surface 40 of the protrusion 38. The apertures 78 are coupled to a pressure source 80. As illustrated in FIGS. 6 and 7, the splice fastener 42 is positioned on the fastener application surface 40 prior to application of the splice fastener 42 (see, for example, FIGS. 4, 5) and is held in place via a low pressure such as a vacuum created by the pressure source 80 through the apertures 78. In one embodiment, the low pressure may be eliminated during placement of the splice fastener 42 to the web ends 62, 64 as shown in FIG. 5 to allow easier release of the splice fastener 42 from the fastener application surface 40. In another embodiment, the pressure source 80 may create a high pressure during placement of the splice fastener 42 to the web ends 62, 64 as shown in FIG. 5 to force the release of the splice fastener 42 from the fastener application surface 40.

Figure 8:
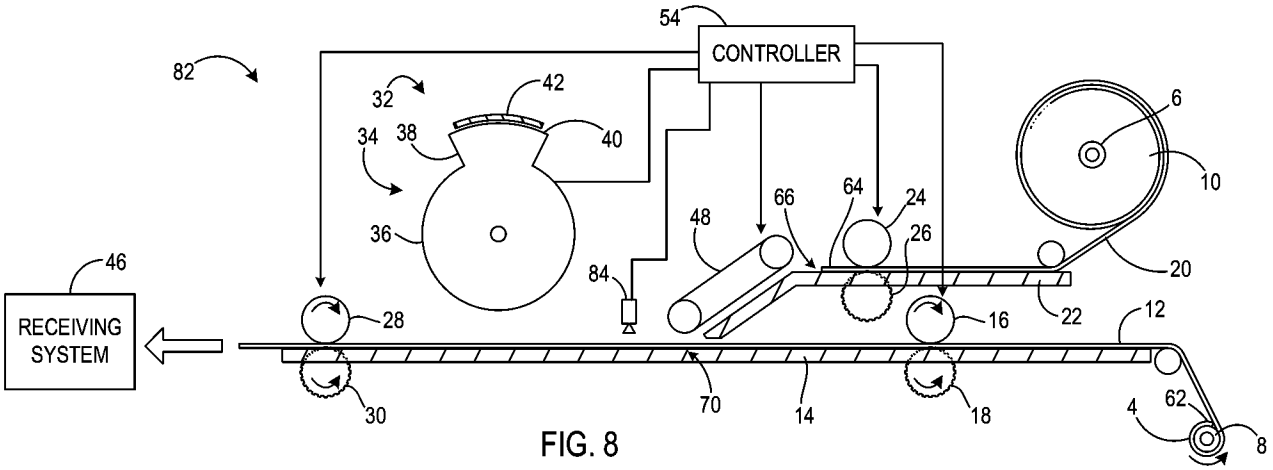
FIG. 8 illustrates a splicing assembly according to another embodiment of the invention.

FIG. 8 illustrates a splicing assembly 82 according to another embodiment of the invention. Elements and components in common between the splice assembly 2 and the splice assembly 82 are described above and are not repeated for simplicity. In contrast to the splice assembly 2 illustrated in FIGS. 1-7, the splice assembly 82 of FIG. 8 uses a single web sensor 84 of one of the types described herein and configured to detect the placements and positions of the first and second webs 12, 20. Via the web sensor 84, the controller 54 may determine when the trailing end 62 of the supply roll 4 has been detected to begin accelerating the leading end 64 of the replacement roll 6. Because of the placement of the single web sensor 84 after the merge point 70, the controller 54 may not know a precise location of the starting point 66. However, based on the speed of the trailing end 62 and the speed of the leading end 64 and its detection by the web sensor 84, the controller 54 may calculate any remaining distance that the leading end 64 needs to expectantly travel in order to be positioned adjacently to the trailing end 62.

In another embodiment, all sensors 50, 52, 84 described herein or a portion thereof together with any additional sensors may be used to control the webs 12, 20 in preparation for splicing.

Figure 9:
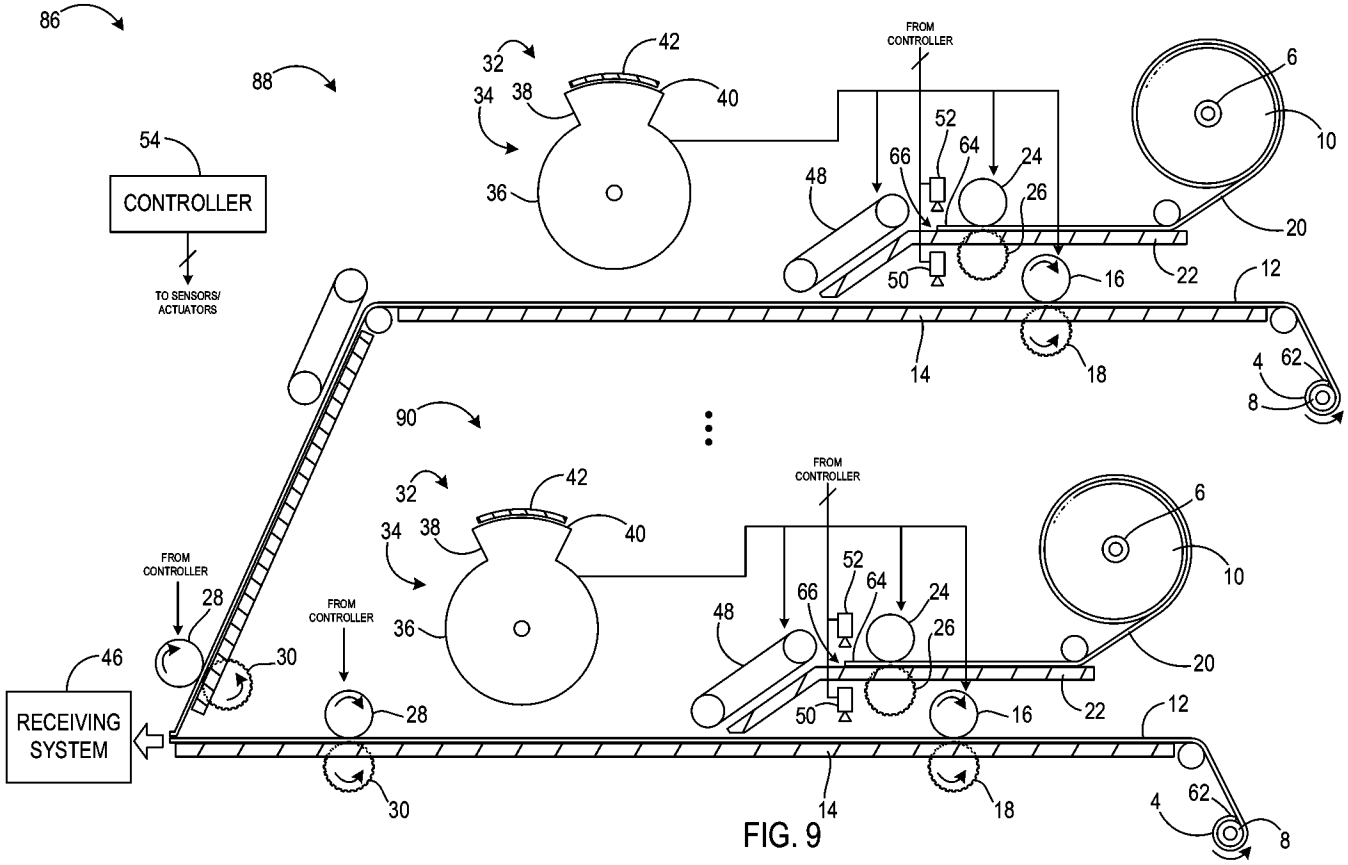
FIG. 9 illustrates a splicing assembly system according to another embodiment of the invention.

Referring to FIG. 9, a splice assembly system 86 is illustrated according to an alternative embodiment that includes multiple splice assemblies 88, 90 positioned to provide a combination output of multiple webs (e.g., first web 12, second web 20, etc.) to the receiving system 46. While FIG. 9 illustrates the splice assembly 88 as being above the splice assembly 90, other orientations are also possible that allow the running webs from both splice assemblies 88, 90 to be fed, independently or concurrently, to the receiving system 46. Furthermore, while two splice assemblies 88, 90 are illustrated, embodiments of the invention contemplate that more than two splice assemblies may be included to provide additional continuous web feeds to the downstream processing apparatus. In one example, the first and second material rolls 4, 6 of the first splice assembly 88 may be a wood pulp-based product while the first and second material rolls 4, 6 of the second splice assembly 90 may be a eucalyptus- or bamboo-based product. The combination of these materials in a predetermined ratio can be used to create a fiberized material ideal for disposable absorbent products, for example. Based on properties of the respective materials such as density, thickness, width, etc., the respective materials may be fed to the receiving system 46 at different speeds to achieve a desired material ratio. Thus, the controller 54 may be programmed to cause the first splice assembly 88 to operate at a first running speed different from the running speed of the second splice assembly 90. Other suitable web materials include nonwoven, tape, cellulose pulp, tissue paper, poly, acquisition, and elastic materials.

Figure 10:
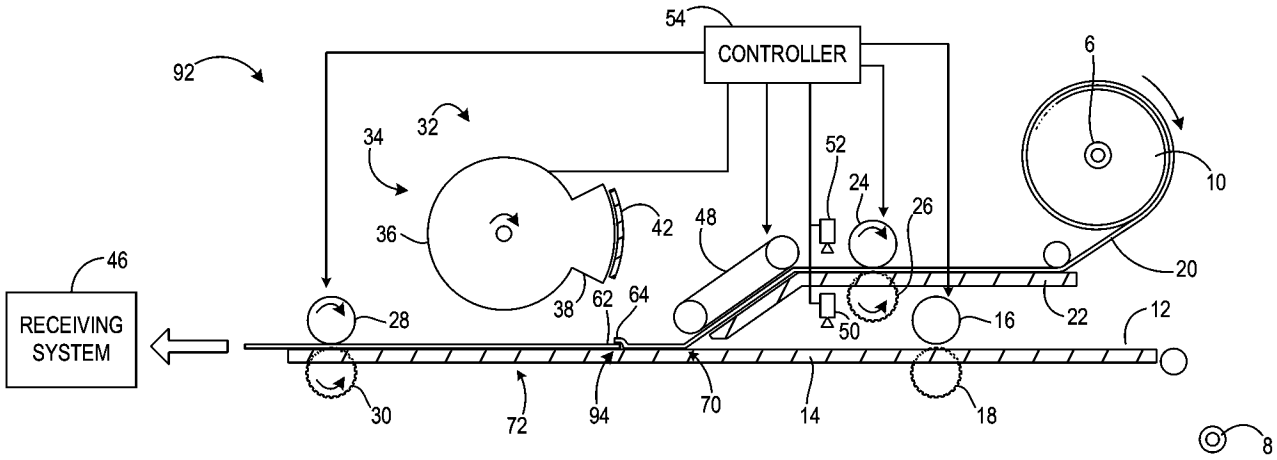
FIG. 10 illustrates a splicing assembly according to another embodiment of the invention.

FIG. 10 illustrates a splice assembly 92 according to another embodiment of the invention. Elements and components in common between the splice assemblies 2, 82, 88, 90 and the splice assembly 92 are described above and are not repeated for simplicity. In contrast to the splice assembly 2 illustrated in FIGS. 1-7, the controller 54 of the splice assembly 92 operates to control the input rollers 16, 18, 24, 26 to create a lap joint 94 where the trailing end 62 of the first web 12 and the leading end 64 of the second web 20 are spliced or joined together in an overlapping arrangement. Similar to FIG. 4, the splice fastener applicator 34 of FIG. 10 is shown to have begun its rotation in preparation for applying the splice fastener 42 to the lap joint 94.

Figure 11:
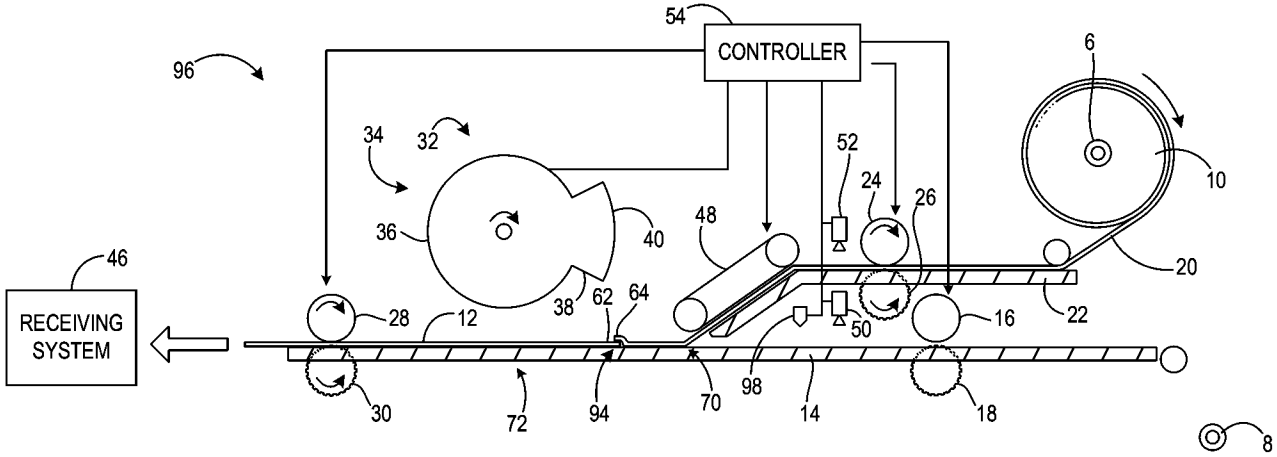
FIG. 11 illustrates a splicing assembly according to another embodiment of the invention.

With the overlapping of the trailing end 62 of the first web 12 and the leading end 64 of the second web 20, other types of web fastening may be used to join the webs 12, 20 together in addition or alternatively to tape being used for the splice fastener 42. In one embodiment as illustrated in FIG. 11, a splice assembly 96 includes an adhesive applicator 98 controlled by the controller 54 to apply an adhesive to the first web 12 for joining the leading or trailing edges 62, 64 of the first web 12 to respective trailing or leading edges 64, 62 of the second web 20. The surface 40 of the protrusion 38 of the web joiner 32 may, as illustrated in FIG. 11, may be configured to apply a pressure or force to the lap joint 94 to press the edges 62, 64 together after the adhesive has been applied. In addition, the surface 40 may also apply a fastener 42 as described in previous embodiments.

Figure 12:
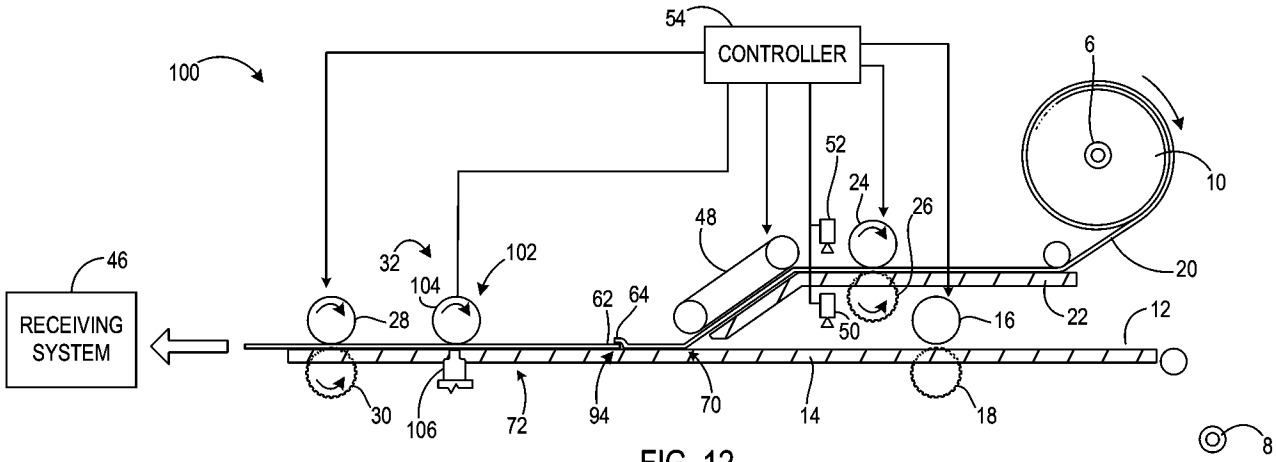
FIG. 12 illustrates a splicing assembly according to another embodiment of the invention.

In another embodiment illustrated in FIG. 12, the web joiner 32 of a splice assembly 100 includes a bonding apparatus 102 positioned to join the webs 12, 20 together. Bonding apparatus 102 may be any known ultrasonic welding system in alternative embodiments, including, as non-limiting examples, a rotary ultrasonic welding system or a blade ultrasonic welding system. In the illustrated embodiment, bonding apparatus 102 includes a rotary anvil 104 and an ultrasonic fixed blade horn 106, also known as a sonotrode, which cooperate with each other to bond (i.e., fuse) the edges 62, 64 of webs 12, 20 together without adhesive. Alternative embodiments may include multiple fixed blade horns or one or more rotary horns. The ultrasonic emission of energy from bonding apparatus 102 is concentrated at specific bond points where frictional heat fuses the layers of web together without the need for consumable adhesives. While bonding apparatus 102 is described herein as an ultrasonic bonding assembly that ultrasonically fuses layers of web together, it is contemplated that the techniques described herein may be extended to any other known welding or bonding techniques that fuse together two or more material layers without the use of adhesive, including ultrasonic, thermal, or pressure bonding techniques and various other forms of welding known in the industry.

A technical contribution for the disclosed method and apparatus is that it provides for a controller-implemented technique for creating a butt splice between the end of an expiring web and the end of a subsequent web by determining a position of a trailing end of a traveling web, causing a leading end of a replacement web to be positioned adjacently to the trailing end, and controlling a web joiner to create a joint coupling the trailing end to the leading end.

Therefore, according to one embodiment of the invention, an apparatus for splicing comprises a first web support surface configured to support a traveling web thereon and a second web support surface configured to support a replacement web thereon. The first traveling web travels in a machine direction. The splicing assembly also comprises a first web sensor and a web joiner. A controller is configured to determine, via the first web sensor, a position of a trailing end of the traveling web and to, in response to determining the position of the trailing end, cause a leading end of the replacement web to be positioned adjacently to the trailing end. The computer is also configured to control the web joiner to create a joint coupling the trailing end to the leading end.

In accordance with another embodiment of the invention, a method for splicing a first web to a second web comprises detecting a position of a trailing edge of a traveling web traveling in a machine direction and positioning a leading edge of a supply web adjacently to the trailing edge. The method also comprises actuating a web joiner and creating a joint between the trailing edge and the leading edge via the web joiner to couple the trailing edge of the traveling web to the leading edge of the supply web.

In accordance with yet another embodiment of the invention, a splicing system comprises first and second splicing assemblies. The first splicing assembly comprises first and second support surfaces configured to support respective first and second material webs thereon and a fastener applicator configured to apply a first fastener to the first and second material webs. The second splicing assembly comprises third and fourth support surfaces configured to support respective third and fourth material webs thereon and a fastener applicator configured to apply a second fastener to the third and fourth material webs. The splicing system also comprises a web edge detection system, a receiving system configured to receive the first, second, third, and fourth material webs, and a controller. The controller is configured to determine, via the web edge detection system, a position of a trailing end of the first material web, to cause a leading end of the second material web to be positioned adjacently to the determined trailing end position of the first material web, and to control the fastener applicator of the first splicing assembly to couple the trailing end of the first material web to the leading end of the second material web via the first fastener. The controller is also configured to determine, via the web edge detection system, a position of a trailing end of the third material web, to cause a leading end of the fourth material web to be positioned adjacently to the determined trailing end position of the third material web, to control the fastener applicator of the first splicing assembly to couple the trailing end of the third material web to the leading end of the fourth material web via the second fastener, and to supply the joined first and second material webs and the joined third and fourth material webs to the receiving system.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description but is only limited by the scope of the appended claims.

What is claimed is:

1. A splicing assembly comprising:

a first web support surface configured to support a traveling web having a trailing end thereon;

a second web support surface configured to support a replacement web thereon;

a first web end sensor;

a web joiner; and a controller configured to:

determine, via the first web end sensor, a position of the trailing end of the traveling web when the traveling web passes a detection point in a sensing area of the first web end sensor;

in response to determining the position of the trailing end, cause a leading end of the replacement web to be positioned adjacently to the trailing end; and control the web joiner to create a joint coupling the trailing end to the leading end.

2. The splicing assembly of claim 1, wherein the web joiner comprises a splice fastener applicator; and wherein the controller, in being configured to control the web joiner, is configured to apply a splice fastener to the trailing end and to the leading end while the traveling and replacement webs are traveling in a machine direction.

3. The splicing assembly of claim 1, wherein the controller, in being configured to control the web joiner to create the joint, is configured to control the web joiner to create a butt joint between the trailing end and the leading end.

4. The splicing assembly of claim 1, wherein the controller, in being configured to control the web joiner to create the joint, is configured to control the web joiner to create a lap joint between the trailing end and the leading end.

5. The splicing assembly of claim 1, wherein the controller is further configured to:

accelerate a speed of the replacement web from an initial speed to a second speed, the second speed faster than a traveling speed of the traveling web; and decelerate the second speed to a speed matching the traveling speed of the traveling web.

6. The splicing assembly of claim 1, wherein the splice fastener comprises tape.

7. The splicing assembly of claim 1, wherein the splice fastener applicator comprises:

a wheel;

a protrusion extending from the wheel; and wherein the protrusion comprises a fastener application surface configured to receive the splice fastener.

8. The splicing assembly of claim 7, wherein the fastener application surface comprises a plurality of apertures coupled to a pressure source, wherein the pressure source is configured to create vacuum through the plurality of apertures.

9. The splicing assembly of claim 1, wherein the first web end sensor comprises an optical camera.

10. A method for splicing a first web to a second web, the method comprising:

detecting a position of a trailing edge of a traveling web traveling in a machine direction;

positioning a leading edge of a supply web adjacently to the trailing edge;

actuating a web joiner; and creating a joint between the trailing edge and the leading edge via the web joiner to couple the trailing edge of the traveling web to the leading edge of the supply web.

11. The method of claim 10, wherein actuating the web joiner comprises actuating a splice fastener; and wherein creating the joint comprises actuating the splice fastener to apply a splice fastener to the trailing edge of the traveling web and the leading edge of the supply web to create a butt joint therebetween.

12. The method of claim 10, wherein actuating the web joiner comprises actuating a bonding apparatus;

wherein applying the joint comprises bonding the trailing edge of the traveling web and the leading edge of the supply web absent adhesive to create a lap joint; and wherein the trailing edge of the traveling web overlaps the leading edge of the supply web.

13. The method of claim 10, wherein positioning the leading edge of the supply web adjacently to the trailing edge comprises accelerating the supply web from an initial speed to a second speed; and wherein the second speed is faster than a speed of the traveling web.

14. The method of claim 13 further comprising decelerating the second speed to a speed matching the speed of the traveling web.

15. A splicing system comprising:

a first splicing assembly comprising:

first and second support surfaces configured to support respective first and second material webs thereon;

a fastener applicator configured to apply a first fastener to the first and second material webs;

a second splicing assembly comprising:

third and fourth support surfaces configured to support respective third and fourth material webs thereon;

a fastener applicator configured to apply a second fastener to the third and fourth material webs;

a web edge detection system;

a receiving system configured to receive the first, second, third, and fourth material webs; and a controller configured to:

determine, via the web edge detection system, a position of a trailing end of the first material web when the first material web passes a detection point in a sensing area of a first web end sensor;

cause a leading end of the second material web to be positioned adjacently to the determined trailing end position of the first material web;

control the fastener applicator of the first splicing assembly to couple the trailing end of the first material web to the leading end of the second material web via the first fastener;

determine, via the web edge detection system, a position of a trailing end of the third material web when the third material web passes a detection point in a sensing area of a second web end sensor;

cause a leading end of the fourth material web to be positioned adjacently to the determined trailing end position of the third material web;

control the fastener applicator of the first splicing assembly to couple the trailing end of the third material web to the leading end of the fourth material web via the second fastener; and supply the joined first and second material webs and the joined third and fourth material webs to the receiving system.

16. The splicing system of claim 15, wherein the receiving system comprises a fiberizer configured to fiberize the first, second, third, and fourth material webs.

17. The splicing system of claim 15, wherein the first and second material webs comprise a pulp-based material.

18. The splicing system of claim 17, wherein the third and fourth material webs comprise one of a eucalyptus-based material and a bamboo-based material.

19. The splicing system of claim 15, wherein the controller is further programmed to supply the joined first and second material webs to the receiving system at a different speed than the joined third and fourth material webs.

20. The splicing system of claim 15, wherein the first and second fasteners comprise tape.

* * * * *